US006219003B1

(12) United States Patent
Chandler

(10) Patent No.: US 6,219,003 B1
(45) Date of Patent: Apr. 17, 2001

(54) RESISTIVE TAPER FOR DENSE PACKED FEEDS FOR CELLULAR SPOT BEAM SATELLITE COVERAGE

(75) Inventor: Charles W. Chandler, San Gabriel, CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/346,445

(22) Filed: Jul. 1, 1999

(51) Int. Cl.[7] ..... H01Q 13/00
(52) U.S. Cl. ..... 343/779; 343/912; 343/840
(58) Field of Search ..... 343/840, 834, 343/749, DIG. 2, 781 R, 909, 782, 779, 912, 913

(56) References Cited

U.S. PATENT DOCUMENTS

| | | | | |
|---|---|---|---|---|
| 4,342,036 | * | 7/1982 | Scott et al. | 343/836 |
| 5,134,423 | * | 7/1992 | Haupt | 343/912 |
| 5,557,291 | * | 9/1996 | Chu et al. | 343/725 |

OTHER PUBLICATIONS

Bucci, et al. "Control of Reflector Antennas Performance by Rim Loading", IEEE Transactions on Antennas and Propagation, vol. AP–29, No. 5, Sep. 1981, pp. 733–779.

Bucci, et al. "Rim Loaded Reflector Antennas", IEEE Transactions on Antennas and Propagation, vol. AP–28, No. 3, May 1980, pp 297–305.

* cited by examiner

*Primary Examiner*—Michael C. Wimer
*Assistant Examiner*—Ephrem Alemu
(74) *Attorney, Agent, or Firm*—Michael S. Yatsko; Ronald M. Goldman

(57) ABSTRACT

Providing a tapered surface reflectivity to the reflecting surface of the parabolic reflector in a parabolic antenna using resistive material reduces side lobes and produces steeper roll off in the principal lobe, permitting use in the antenna of a smaller diameter microwave feed than required by an antenna without that tapered surface resistivity and, effectively, emulates the latter antenna. As a consequence of the smaller feed diameter, multiple feeds may be positioned contiguously to form multi-beam antennas that produce contiguous beam patterns. A satellite cellular communications multi-beam antenna incorporating the invention achieves greater regional coverage of the Earth.

14 Claims, 3 Drawing Sheets

RESISTIVE TAPER FOR DENSE PACKED FEEDS FOR CELLULAR SPOT BEAM SATELLITE COVERAGE

FIELD OF THE INVENTION

This invention relates to multi-beam satellite antennas, and, more particularly, to satellite multi-beam antennas used in cellular communications systems to provide coverage over wide geographic areas of Earth.

BACKGROUND

Modern cellular communications systems employ satellite based links for relaying microwave signals between different Earth based stations, either or both of which may be mobile, and which may be located in different widely separated geographic regions. The satellite contains RF transponder systems that are capable of receiving and, through its microwave transmitter, relaying signals from many different stations on Earth to other stations simultaneously. A key component in that transponder system is the microwave transmitting (or receiving) antenna, which, typically, is a reflector antenna. A reflector antenna as is known employs a microwave feed horn and a parabolic reflector. Microwave energy emanating from the feed is directed onto the parabolic reflector and, thence, is radiated from that reflector into space.

Ideally, one would wish to communicate with all areas on Earth with a single satellite based cellular communication system. However, it is not technologically possible to realize that goal. The reality is that the geographic coverage of a single satellite system is much more limited in scope. The reason is principally two fold: the transmitted power level, that is the wattage, of the transponder's transmitter, and the directional characteristics of the transmitting antenna (or antennas).

The directional characteristic of the parabolic antenna is well known. Most of the RF energy fed to the antenna is radiated in a particular pattern, referred to as its principal lobe. The principal lobe is oriented in the desired direction along the reflector's parabolic axis, while some RF energy is radiated off axis, referred to as the side lobes. To visualize the shape of those lobes, and hence the antenna's directionality, using appropriate radiation measurement apparatus, one measures at the various angular positions about the antenna to find locations at which field strength or power, expressed in $V_{1m}$ (watts), bears a fixed ratio, suitably 6 dB, to that of the peak power, and those locations are plotted graphically relative to the angular distance from the antenna's axis. That technique provides a graphical outline or plot of that intensity. The shape of that plot is the antenna's directional characteristic.

The foregoing describes the antenna as a transmitting antenna. As those skilled in the art appreciate, the foregoing antennas are alternatively used both for transmitting and receiving microwaves using known transmitting and receiving apparatus. As further understood, the antenna is reciprocal in its electromagnetic characteristics. That is, it's directional characteristic for receiving is substantially the same characteristic obtained for transmitting microwave energy. Thus while this description speaks in terms of transmitting microwave energy for convenience and ease of description, it is expressly understood to apply also to the antenna when used in a receiving mode.

The principal lobe of a parabolic antenna is normally most intense along the antenna's axis and tapers off in any off-axis direction. The greater the angle off the axis, the lesser is the intensity, until in the radial direction, energy increases to form side lobes.

When those RF field measurements are taken along a plane perpendicular to the parabolic axis and plotted, a generally circular pattern is obtained for the principal lobe. Locations within the circle generally have greater intensity than points outside the circle. The latter situation is akin to the relationship of a parabolic antenna on board a satellite hundreds of miles or more above the earth, in which the antenna is directed toward a location on the earth.

From the reflector's position on the satellite radiating transmitted microwave energy to the Earth, and with the RF power directed into the reflector by the microwave feed being a constant, one finds a region on the earth where the level of received energy is sufficient for reliable telecommunications with the satellite. That region is called the antenna's "foot print". Outside of that region telecommunications are not reliable with normal communications receivers because the received RF signals are substantially at or below the receiver's electronic noise floor and become electronically unintelligible. Qualitatively, the foot print of the circular parabolic antenna is substantially a circle or, more accurately, a circle projected upon a sphere, which forms an ellipse. Should advances in communications receivers or higher power transmitters occur in the future, such more advanced equipment will of course enable one to expand the antenna's footprint to cover additional real estate on the Earth. Even with those improvements, however, those skilled in the art recognize that earth coverage of a single high gain antenna is not feasible.

In practice one finds that the antenna in the foregoing system possesses a foot print that does not cover a sufficiently large geographic region. To somewhat remedy that situation, multiple beam antenna systems have been proposed. Ideally, a multiple beam system would produce a series of separate beams of microwave radiation whose individual footprints on the Earth are substantially contiguous with one another and may have some slight overlap. To uniformly accomplish the foregoing reception pattern requires the formed beams to be highly circular in symmetry, the main beam or lobe possesses a steep "rolloff" and produces low sidelobes to avoid interference to surrounding areas covered by any other beams.

Each such beam originates from an associated microwave feed that is directed to a single reflector. A typical multiple beam antenna incorporates three or more distinct microwave feeds. Of necessity those feeds are constrained to a maximum size determined by the effective focal length and angular separation of adjacent beams. Often these are slightly overlapping to maintain high edge of coverage gain. With a constrained maximum feed size, the feed illumination of the parabolic reflector cannot have any desired amplitude distribution and the beam produced does not guarantee circular beam symmetry, steep main beam roll off and low side lobes.

As is known, the size of the microwave feed influences the spatial distribution of microwave energy reflected from the antenna's reflector. By size, reference is being made to the physical diameter of the outlet or exit of the microwave horn that serves to direct the microwave energy being transmitted onto the associated reflector from whence that energy is radiated into space. The smallest size feed produces a beam that more uniformly radiates the full surface of the reflector including the reflector's edges and beyond, producing a narrow principal lobe to the beam, but also, disadvantageously, producing high side lobes as well. Since the side lobes are directed off boresight, and not toward the angle at which the reflector's axis is directed, the energy in those side lobes is essentially lost, or wasted or interferes with adjacent coverage area beams. To better concentrate more of the radiation into the principal lobe, one normally thus employs a larger sized microwave feed.

With a larger sized microwave feed, the energy radiated by the feed toward the reflector is more focused, that is, is more confined to the reflector's central area and less or none to the reflector's outer edges. The effect is to maximize the principal lobe, and minimize the side lobes, thereby using the microwave energy emanating from the microwave feed more efficiently. The latter arrangement is also found to produce an additional effect that is beneficial to the present invention. The "roll-off" of the beam is enhanced. That is, the principal lobe's intensity drops off more quickly as the boresight angle off the reflector axis attains a particular angle and becomes negligible as the angle increases there beyond, until the vicinity of the low-level side lobes is attained at extreme off-axis locations. The latter is the accepted engineering practice for a single beam antenna.

A multi-beam antenna requires many individual microwave feeds that use a single parabolic reflector in common. At most, only one of those feeds can be located at the reflector's focal point. Attempting to take advantage of the benefit of the large size microwave feeds, one finds that placing a number of large size feeds side by side in a focal plane confronting the reflector takes up too much space. Apart from the one feed that may be located at the focal point, the remaining feeds are displaced too far from the focal point to provide the kind of spatial radiation of the reflector necessary to obtain the desired direction of radiation characteristics achieved in the single beam antenna. As a consequence, the microwave beams produced cover separate regions of the Earth that are disconnected from one another, that is, are discontinuous; their respective footprints are separated. Such an antenna structure is therefore unacceptable for cellular communications systems where continuity of real estate coverage is desired. The obvious physical constraint renders that impractical for the multi-beam configuration.

Of necessity therefore, existing multi-beam satellite cellular communications antennas continue to use small size microwave feeds, notwithstanding the described inefficiencies.

The multi-beam satellite cellular communications antenna of the present invention also employs small size microwave feeds. However, applicant has discovered the means to make those small size microwave feeds emulate the large size feeds. The invention thus accepts the physical limitation on feed size while obtaining the beneficial spatial characteristics of the larger sized feeds. That emulation is achieved through recognition of a previously unrecognized effect incident to resistive tapering of reflectors and application of that effect within a multi-beam antenna. An interesting phenomenon recognized in the prior art literature is that a resistive coating on the parabolic reflector can be used to reduce the antenna's side lobes, which is disclosed in U.S. Pat. No. 5,134,423, granted Jul. 28, 1992 to Haupt (the "Haupt" patent). Unrecognized in the Haupt patent and discovered by the present inventor, is that the resistive coating also has an effect on the characteristics of the antenna's principal lobe. In achieving the new multi-feed antenna, the present invention also makes use of a resistive taper on the parabolic reflector, capitalizing upon and quantifying that previously unrecognized effect.

Accordingly, an object of the present invention is to provide a new multi-beam satellite antenna structure.

An additional object is to provide a parabolic antenna with a small size microwave feed that emulates a prior parabolic antenna containing a large size microwave feed.

A still additional object of the invention is to produce a multi-beam microwave antenna whose beams provide coverage of contiguous regions on Earth.

And a further object of the invention is to provide in a satellite antenna structure multiple contiguously positioned small sized microwave feeds that electromagnetically emulate microwave feeds of a larger physical size.

SUMMARY OF THE INVENTION

In accordance with the foregoing objects and advantages, the new multi-beam parabolic antenna is characterized by resistive tapers of about one-quarter wavelength in thickness added to the parabolic reflector to produce a tapered reflectivity to an outer portion of the reflector surface, which effectively reduces side lobes and produces steeper roll off of the principal lobe near the edge of coverage angles. This permits use of a smaller diameter microwave feed than required by an antenna that does not contain that tapered surface reflective resistivity. The result is to effectively emulate a prior reflector antenna containing a larger size microwave feed. With the foregoing reflector, a small size microwave feed, that is, a feed of a diameter of one wavelength or less, in the combination accomplishes that obtained with a large size feed, that is, a feed of a diameter of two wavelengths or larger in the prior combination.

Concentrated in a band between one diameter, internal of the reflector, and the outer diameter, at the reflector's edge, the coating tapers from a totally reflective one to a totally absorbent one at the reflector's outer diameter. As a consequence of the smaller feed diameter, it becomes possible to position multiple feeds contiguously to form multi-beam antennas that take advantage of the steeper roll-off in the principal lobes to produce essentially contiguous beam patterns. A satellite cellular communications multi-beam antenna incorporating the invention achieves greater regional to global coverage of the Earth.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DESCRIPTION OF THE PREFERRED EMBODIMENTS

Figure 1:
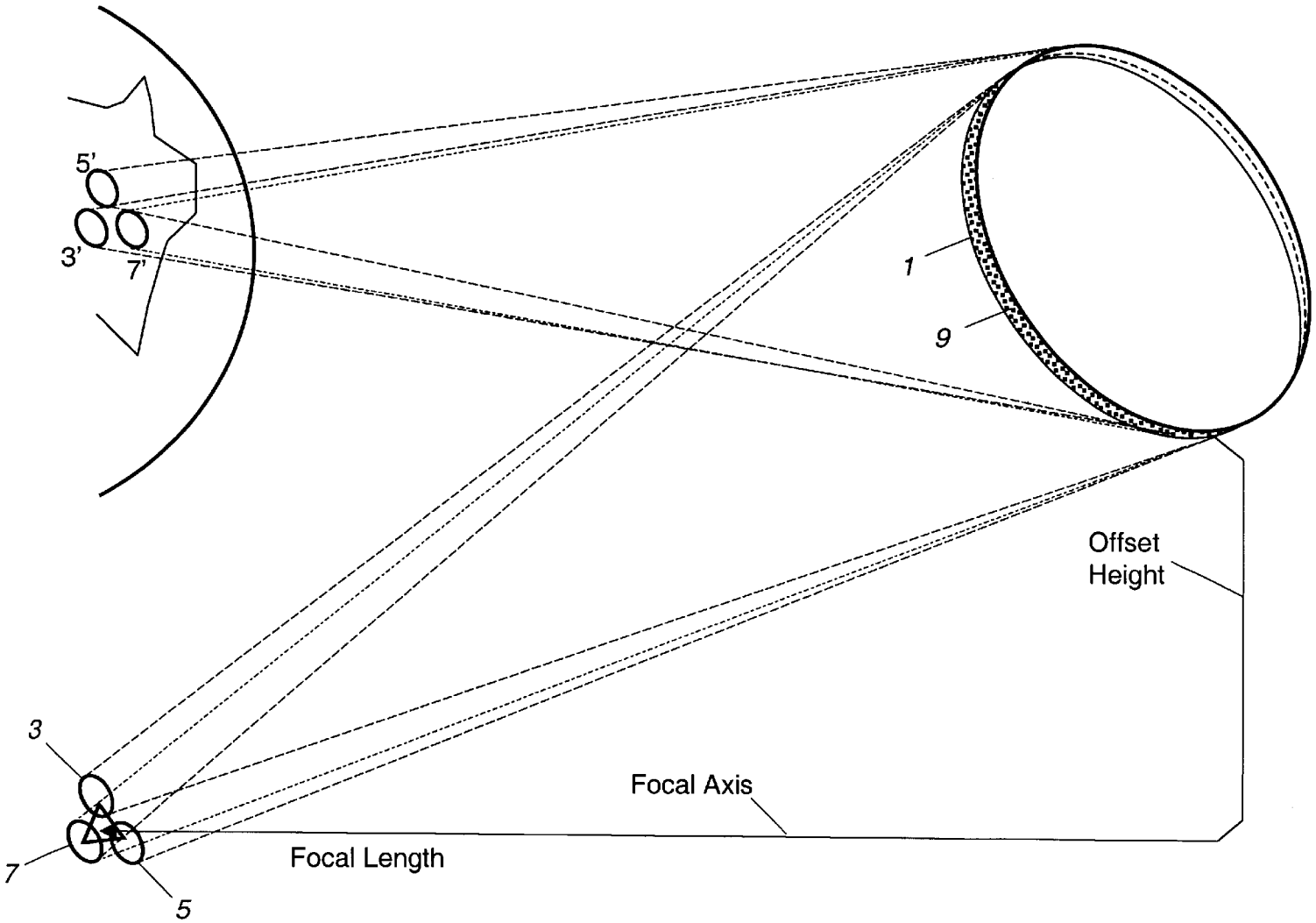
FIG. 1 is a pictorial illustration of the multi-beam parabolic antenna.

Reference is made to FIG. 1 pictorially illustrating a multi-beam antenna constructed in accordance with the invention. The antenna's principal elements are the parabolic reflector 1 and three microwave feeds 3, 5 and 7, partially illustrated. The three feeds are identical in structure. Each contains an output end or aperture that is circular in geometry and the diameter of those circular ends are of equal size.

The feed apertures face the reflector 1 to illuminate the reflector with microwave energy originating from an external transmitter or transmitters, not illustrated. They are packed together at or near the focal point of the parabolic reflector. Since it is not physically possible to position all the feeds precisely at the focal point, they are grouped so as to form an equilateral triangle, and, as a compromise, the center of that imaginary triangle is positioned at the focal point. In alternative embodiments the feeds may be placed contiguous with one another in a straight line, with the middle feed being located at the focal point.

For clarity of illustration and to permit the reader to more readily understand the invention, the various support structures for supporting the foregoing microwave fees and the reflector, which are well known by those skilled in the art, are not illustrated and need not be described.

With one exception, reflector 1 is constructed of conventional materials, such as a metal or a conductive metal coating on non-conductive or partially conductive composite material, in the conventional manner to form the material into a reflective surface of the desired paraboloid geometry. The exception is that a band-like portion or segment of the outer diameter of the reflector facing feeds 3, 5 and 7 also contains a surface coating of resistive material 9, whose reflectance to microwave energy increases as a linear function of the paraboloid's radius. The resistive material is of a thickness of one-quarter wavelength at the center frequency, f, of the microwave energy for which the antenna is designed. This is better illustrated in FIG. 2A to which reference is made.

Figure 2B:
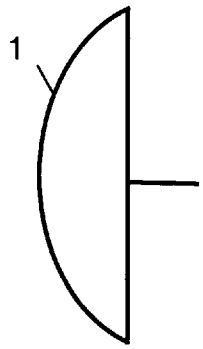
FIG. 2*a* is a front end view of the parabolic reflector of the antenna of FIG. 1 drawn to reduced scale and FIG. 2*b* is a side view of that reflector.
Figure 2A:
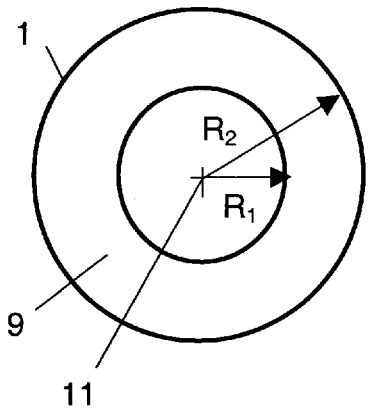

FIG. 2A illustrates reflector 1 of FIG. 1 as viewed from the paraboloid's axis 11, drawn in a smaller scale. As so viewed the geometry appears as circular and extends to an outer radius R2. The resistive coating is applied starting at a radius R1. The coating is increased in surface reflectivity linearly as the radius increases. This is referred to as a reflective resistive taper. The portion of reflector 1 between radius R1 and the outer Radius (and edge) R2 are thereby covered with the tapered reflective resistive coating 9 of predetermined thickness while the portion between the reflector's center and radius R1 remains as exposed conductive surface. FIG. 2B is included merely for completeness to show reflector 1 in side view illustrating its parabolic curvature.

The foregoing resistive coating may be accomplished, for one, by using a carbon loaded honeycomb material. To form that coating, a layer of conventional honeycomb material, a dielectric, that is one-quarter wavelength thick is bonded or otherwise permanently attached to the conductive surface of the reflector in an annular band in the region of the reflector between radii R1 and R2. That region of the reflector is then dipped "head first" into a bath of carbon resin solution, allowing the carbon solution to permeate the honeycomb. The reflector is then withdrawn from the carbon bath and allowed to dry with the front of the antenna facing down. While still wet, under the influence of gravity, portions of the carbon solution gravitates toward the outer edge of the reflector as the reflector drys. As a consequence less carbon is found at the smaller radius portion of the band, R1, and a greater amount of carbon is concentrated at the outer radius, R2, producing a tapered resistance. Incident microwave energy from the microwave feeds that is incident at the outer periphery of the reflector, at R2, penetrates into the reflective resistive layer and, ideally, is fully absorbed by the resistive material. Microwave energy that is incident at the inner portion of the band, at R1, is, ideally, fully reflected, since there is little or no resistive material at that location to absorb the microwave energy. Microwave energy from the feed incident at a location on the resistive band between those extremes is partially reflected and partially absorbed in the intermediate quantity of resistive material at that location. Ideally, the distribution of the resistive ingredient is such as to make that reflectivity linear as a function of the diameter. The region of the reflector between its center and radius R1, being a conductive metal surface, of course remains fully reflective.

Generally, any of the various radar absorbing materials and techniques described in the book by Knott, Shaeffer & Tuley, "*Radar Cross Section*", Artech House, Inc., copyright 1985, Chapter 9, Radar Absorbers, pp 239–272, may be used. Although the function of the radar absorbers presented in the cited book is to fully absorb microwave energy, as example, for hiding aircraft from active microwave radar signals, the techniques are useful in and may be adapted to the present invention, in which varied amounts of reflection is desired. It should be appreciated that as yet the best mix of resistive ingredients and layer thickness for the best practical implementation of the present invention has not been determined and could be determined through additional experimentation along the procedures described.

As those skilled in the art appreciate from an understanding of the present invention, other equivalent resistive materials and application techniques may be employed as an alternative to the foregoing. And as described in the next embodiment, different resistive materials may be used in different annular portions of the reflector.

Figure 3:
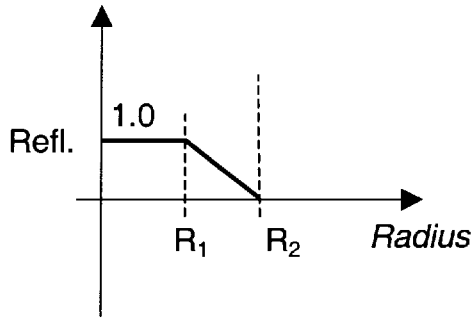
FIG. 3 is a chart of the surface reflectivity of the inner surface of the reflector of FIG. 2*a;*

The foregoing reflective taper is graphically illustrated in FIG. 3, which shows the reflectivity, along the chart's ordinate, increasing from a value of 1.0 or full reflectivity at radius R1 to a 0.1 db, a near zero reflectivity, at the outer radius R2, plotted along the chart's abscissa, while the reflectivity of the exposed electrically conductive reflector surface between the reflector's center and R1 remains at a maximum, at 1.0.

To form the microwave beam in the foregoing multi-beam antenna, each feed is of a diameter, say $D_X$. The formation of a like beam in a single beam antenna that uses the conventional parabolic reflector, that is, one that does not include a reflective-resistive surface coating as described, requires a feed whose diameter is, say $D_Y$, where $D_Y$ is greater than $D_X$. Comparing one to the other, the smaller feed diameter DX is about twenty per cent less than the larger.

Figure 4:
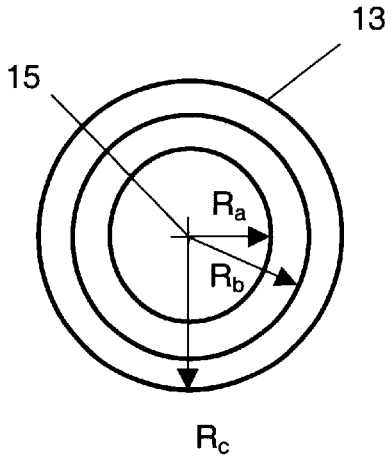
FIG. 4 illustrates in front end view an alternative reflector for the antenna of FIG. 1.

Reference is made to FIG. 4, which illustrates an alternative parabolic reflector construction 13 as viewed from the paraboloid's axis 15, drawn to the same scale as the reflector of FIG. 2*a*. As so viewed the geometry is also seen as circular and extends to an outer radius Rc.

In this alternative embodiment the inner surface of the reflector is divided into three regions. The first is the region between the center and radius Ra. That region is retained free of any resistive metal, exposing a surface of substantially 100% reflectivity. The second is the region between radii Ra and Rb. This region is covered by a band of resistance material having a first resistivity, such as the Carbon material of the prior embodiment in a thickness of one-quarter wavelength of the center frequency at which the antenna is intended to operate. The foregoing resistivity is tapered linearly as a function of the radius between the two radii using the same technique as described in connection with the reflector in the preceding embodiment to produce a tapered reflectivity. The third region is that between radius Rb and, the outer edge, radius Rc. This third region is covered by another resistance material having a second resistivity, such as Nickel-Chrome (NiCr) material ("Nichrome") or Indium Tin Oxide (ITO), in a layer also one-quarter wavelength thick. The resistivity of this third region is also tapered linearly as a function of the radius between the two radii using the same technique as described in connection with the reflector in the preceding embodiment to produce a tapered reflectivity to this third region. Suitably the maximum resistivity of the front edge of the first described region or band is matched to the minimum resistivity of the second described region or band. Essentially the resistive material is divided into two zones, and this embodiment may be referred to as a two-zone system.

Figure 5:
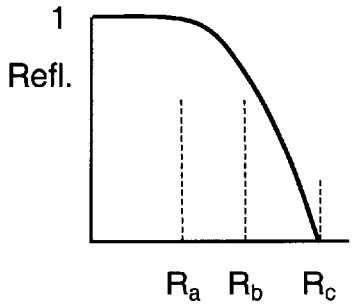
FIG. 5 is a chart of the surface reflectivity of the inner surface of the reflector of FIG. 4.

The foregoing tapered reflectivity is graphically depicted in the chart of FIG. 5, which plots the radius, R, along the abscissa and the surface resistivity along the chart's ordinate.

Figure 6:
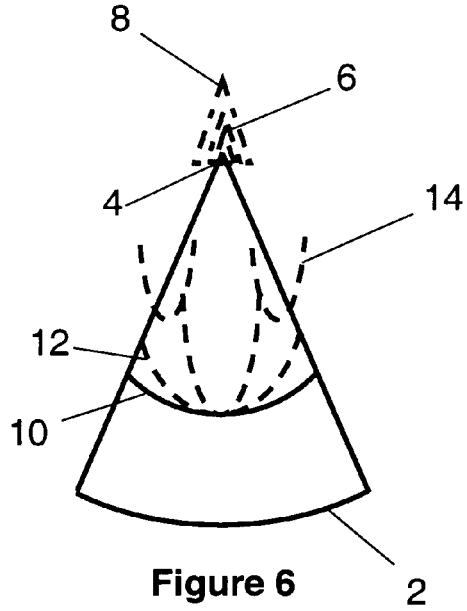
FIG. 6 is a pictorial of a parabolic antenna used in connection with an explanation of the operation of the invention.

As earlier described, a single feed parabolic antenna that contains the described reflective coating emulates the prior single feed parabolic antenna requiring a much larger diameter feed. As example, FIG. 6 illustrates the shape of the microwave beam emitted by feeds of three different sizes toward the associated parabolic reflector 2 in an antenna of conventional structure. The very smallest feed 4, represented by the smallest triangle in the figure, produces a feed beam 10. The small or medium size feed 6, represented by the intermediate triangle, produces a feed beam 12, represented with small dashes. The larger feed 8 produces feed beam 14 represented in large dash line. As is evident, the beam from the largest feed is focused more closely within the boundary of parabolic reflector 2. The corresponding microwave beam radiated from the reflector with each of those feeds is illustrated respectively in FIGS. 7, 8, and 9.

Figure 7:
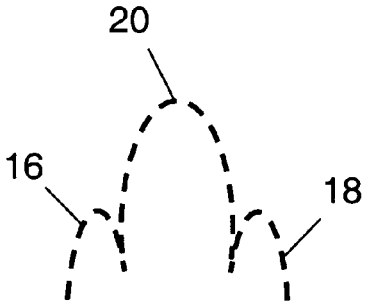
FIGS. 7, 8 and 9 illustrate directivity patterns used in connection with FIG. 6.

The microwave beam radiated from the antenna with the smallest feed is represented in FIG. 7. As illustrated, the beam contains modest side lobes 16 and 18 to each side of the principal lobe 20. The term microwave beam as used herein refers to the angular region containing microwave energy within the half power points. In the absolute sense, microwave energy also falls outside that region with lower power levels. But those lower power levels are discarded in our considerations, since existing receiving equipment reception requires at least that power level for reliable reception. By accepting that power level as the locus of the beam, the beam may be defined and quantified; each beam and their relationship to one another may then be quantified as herein set forth.

Figure 8:
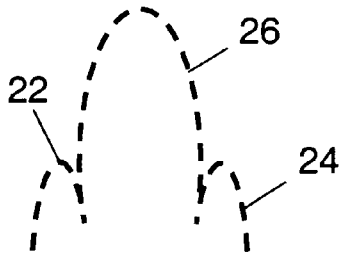

The microwave beam radiated from the antenna containing the small feed 6 is illustrated in FIG. 8. Here the beam contains lower side lobes, 22 and 24, and a much sharper beam roll off to the principal lobe 26. Roll off is defined as the steepness with which the profile of the principal lobe decreases with lateral distance perpendicular to the reflector's axis.

Figure 9:
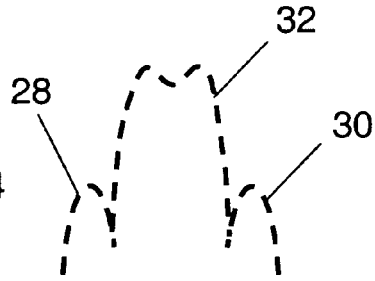

With the largest feed 8, the microwave beam radiated from the antenna is illustrated in FIG. 9. This beam also contains low level side lobes 28 and 30. Importantly, the beam contains the sharpest or steepest roll off to principal lobe 32. It is this latter embodiment which the single feed version of the invention emulates.

With the described resistive coating, the antenna can incorporate a small sized feed such as feed 4. Yet, instead of obtaining the result of FIG. 7, the result obtained is that of FIG. 9, the same as that of a physically large feed. Effectively, the new structure emulates an antenna of a large size microwave feed. The present invention gives that emulation a meaningful purpose as a part of a multi-beam antenna.

The steep beam roll off permits separate microwave beams to be placed side by side, thereby covering contiguous geographic regions. The small size of the feeds allows multiple feeds to be packed closely together about the parabolic reflector's focal point, enabling contiguous multiple beams to be generated. As used in this specification and the appended claims the term, small, in reference to a microwave feed, means that the feed's diameter is one wavelength or smaller; and the term large means that the feed's diameter is no less than two wavelengths in length.

It is believed that the foregoing description of the preferred embodiments of the invention is sufficient in detail to enable one skilled in the art to make and use the invention. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A multi-beam satellite antenna for an in-orbit cellular communication system operating at a center wavelength $\lambda$, comprising:

a reflector, said reflector having a concavely curved front reflecting surface, an axis and a focal point;

a plurality of microwave feeds, each comprising a conical horn having a predetermined exit diameter for emitting and directing microwave energy onto said reflector, wherein microwave energy incident on said reflector is reflected to thereby produce a corresponding plurality of microwave beams, each of said plurality of microwave beams being associated with a respective one of said plurality of microwave feeds;

said reflector including first and second resistive coatings on said concave front reflecting surface and comprising different resistive materials, said first resistive coating defining a first band covering a portion of said front reflective surface;

said first band being oriented coaxial of said axis and being located between an outer end edge of said concave front reflecting surface and a recessed position thereof recessed from said outer end edge;

said first band being of a predetermined thickness and possessing a tapered resistance, tapered between a minimum resistance at said recessed position and a maximum resistance at said outer end edge;

said second resistive coating defining a second band covering a second portion of said front reflective surface;

said second band being oriented coaxial of said axis and being located between said recessed position contiguous with an edge end of said first band and a further recessed position, whereby said first and second bands lie side by side;

said second band being of a predetermined thickness and possessing a tapered resistance, tapered between a minimum resistance at said further recessed position and a maximum resistance at said recessed position; and said microwave feeds being located about said focal point.

2. The invention as defined in claim 1 wherein said plurality of microwave feeds are positioned in contiguous relationship side by side with one another in a line through said focal point.

3. The invention as defined in claim 1 wherein said plurality of microwave feeds are positioned contiguous to one another, wherein said microwave feeds define a triangle that is centered at said focal point.

4. The invention as defined in claim 1, wherein said first resistive coating comprises a material selected from the group consisting of Carbon, Nickel Chromate and Indium Tin Oxide.

5. The invention as defined in claim 1, wherein said predetermined thickness is ¼ th λ.

6. The multi-beam satellite antenna as defined in claim 1, wherein said plurality of microwave feeds comprises at least three microwave feeds, and wherein said exit diameter of said conical horn is no larger than λ.

7. The invention as defined in claim 1, wherein said reflector possesses a circular geometry as viewed from said axis and is of a predetermined outer diameter; and wherein said band is linearly tapered in resistance as a function of said diameter of said reflective surface, whereby the microwave reflectivity of succeeding portions of said band decreases as a function of the increasing axial position of the respective succeeding portions.

8. The invention as defined in claim 7 wherein said concavely curved front reflecting surface reflector comprises a circular parabolic geometry.

9. The invention as defined in claim 1, wherein said second band is linearly tapered in resistance as a function of said diameter of said reflective surface, whereby the microwave reflectivity of succeeding portions of said second band decreases as a function of the increasing axial position of the respective succeeding portions thereof.

10. The invention as defined in claim 9, wherein said maximum resistance of said second band is substantially equal to said minimum resistance of said first band.

11. The invention as defined in claim 10, wherein said plurality of microwave feeds define a triangle that is centered at said focal point.

12. The invention as defined in claim 10, wherein said predetermined thickness of each of said first and second bands is ¼ th λ.

13. The invention as defined in claim 10, wherein said first band comprises a resistive material selected from the group consisting of Nickle Chromate and Indium Tin Oxide; and wherein said second band comprises the resistive material Carbon.

14. A multi-beam satellite antenna for an in-orbit cellular communication system operating at a center wavelength λ that requires multiple beam footprints covering a continuous region of Earth, comprising:

a parabolic reflector, said parabolic reflector having an axis of symmetry, a circular parabolic front reflecting surface having a center, a focal point, and defining a circular geometry as viewed from said axis of symmetry having a circular outer edge and a diameter that varies as a parabolic function of the distance from said center along said axis of symmetry;

a plurality of microwave feeds, said microwave feeds being clustered about said focal point, and each of said microwave feeds comprising a conical horn having a predetermined exit diameter for emitting and directing microwave energy onto said reflector, wherein microwave energy incident on said reflector is reflected to thereby produce a corresponding plurality of microwave beams, each of said plurality of microwave beams being associated with a respective one of said plurality of microwave feeds;

said reflector including first and second resistive coatings on said concave front reflecting surface, said first resistive coating defining a first band covering a portion of said front reflecting surface, and said second resistive coating defining a second band covering another portion of said front reflecting surface contiguous with said first band;

said first band being oriented coaxial of said axis of symmetry and being located between said outer end edge of said front reflecting surface and a recessed position thereof recessed from said outer end edge;

said first band being of a predetermined thickness of one quarter λ and possessing a linearly tapered resistance, linearly tapered as a function of said diameter of said front reflecting surface, between a minimum resistance at said recessed position and a maximum resistance at said outer end edge, whereby the microwave reflectivity of succeeding portions of said first band decreases as a function of the increasing axial position of the respective succeeding portions;

said second band being oriented coaxial of said axis and being located between said recessed position contiguous with an edge end of said first band and a further recessed position, whereby said first and second bands lie side by side;

said second band being of a predetermined thickness of one quarter λ and possessing a linearly tapered resistance, linearly tapered as a function of said diameter of said front reflecting surface, between a minimum resistance at said further recessed position and a maximum resistance at said recessed position, whereby the microwave reflectivity of succeeding portions of said second band decreases as a function of the increasing axial position of the respective succeeding portions;

said maximum resistance of said second band being matched to said minimum resistance of said first band;

said resistive material of said first band comprises a resistive material selected from the group consisting of Nickle Chromate and Indium Tin Oxide; and said resistive material of said second band comprises Carbon.

* * * * *